United States Patent [19]

Greenwell et al.

[11] Patent Number: 5,060,450

[45] Date of Patent: Oct. 29, 1991

[54] APPARATUS FOR SHIFTING PARTICULATE MATERIAL IN POUCHES

[75] Inventors: Joseph D. Greenwell, Florence; Christopher B. Gilmore, Villa Hills, both of Ky.

[73] Assignee: R. A. Jones & Co. Inc., Covington, Ky.

[21] Appl. No.: 593,866

[22] Filed: Oct. 5, 1990

[51] Int. Cl.[5] ..... B65B 43/04; B65B 1/20; B65B 1/06; B65B 63/00

[52] U.S. Cl. ..... 53/113; 53/527; 53/562

[58] Field of Search ..... 53/455, 439, 113, 122, 53/527, 526, 562, 451, 551; 196/405, 412

[56] References Cited

U.S. PATENT DOCUMENTS

| | | | |
|---|---|---|---|
| 2,362,462 | 11/1944 | Belcher et al. | 53/122 |
| 3,371,461 | 3/1968 | Aronson | 53/455 X |
| 3,526,078 | 9/1970 | Dye | 53/526 |
| 3,545,983 | 12/1970 | Woods | 53/451 X |
| 3,581,876 | 6/1971 | Keith | 53/526 X |
| 3,767,028 | 10/1973 | Rosso | 198/405 |
| 3,987,602 | 10/1976 | Stahl | 53/451 X |
| 4,034,537 | 7/1977 | Reil et al. | 53/451 |
| 4,262,473 | 4/1981 | Brooke | 53/541 X |
| 4,527,792 | 7/1985 | Burkhardt | 198/412 X |
| 4,685,553 | 8/1987 | Jennings | 198/405 |
| 4,897,273 | 1/1990 | Kotaki et al. | 53/451 X |

*Primary Examiner*—Horace M. Culver
*Attorney, Agent, or Firm*—Wood, Herron & Evans

[57] ABSTRACT

Apparatus for shifting particulate material from one end of a pouch toward the other. In pouch form, fill, seal apparatus, a web of pouches is filled, the material tending to lodge in the bottom portion of each pouch. A pair of twisted belts pass the web on an upper and lower run wherein the bottom of the pouch is elevated as it passes over the belts to cause a product within the pouches to redistribute itself uniformly throughout the pouch.

7 Claims, 2 Drawing Sheets

APPARATUS FOR SHIFTING PARTICULATE MATERIAL IN POUCHES

BACKGROUND OF THE INVENTION

This invention relates to the manufacture and packaging of pouches of particulate material. The invention is particularly applicable to the pouching of granulated material, such as dry soft drink material, but the invention is also applicable to the pouching of a wide variety of products including dry soups. The invention is particularly directed to producing a uniform distribution of the product within the pouch.

On a pouch machine that fills, for example, 500 pouches per minute, a continuous web of paper/poly is longitudinally folded upon itself and transversely sealed to form pouches. The web is passed about a filler wheel where the pouch walls are bowed outwardly toward a cylindrical condition to enable material to flow smoothly into each pouch. As the web comes off the filler, it is passed through a top sealer that forms a longitudinal seal at the top of the web, thereby closing each pouch.

The nature of the process produces pouches that tend to have more product in the bottom of the pouch than in the top.

The thus formed pouches are cut from the web and are shingled into groups of a predetermined number, the shingled groups of pouches being deposited on the upper runs of conveyor belts. The conveyor belts deliver the shingled pouches in the form of a stack to the product bucket of a cartoning machine. See U.S. Pat. No. 4,043,442. In a cartoner, a barrel loader thrusts the stack of pouches transversely from the product bucket into a carton which is thereafter sealed.

The problem focuses on the use of automatic machinery throughout the process of forming, filling, sealing the pouches, delivering the stack of pouches to a cartoner and thereafter cartoning the pouches. When a stack of pouches is, for example, four to eight pouches high, the fact that the product is primarily or entirely in the bottom half of each pouch produces an instability in the stack. One side of the stack becomes so much higher than the other side of the stack that the stack starts to slide or actually tips over.

Present solutions to the problem involve hand-packing the pouches into cartons or tamping the product in some manner to avoid a slipping or tipping of the stack.

DESCRIPTION OF THE INVENTION BRIEF

An objective of the present invention has been to provide a solution to the problem of instability of a pouch stack that arises out of a nonuniform distribution of product in each pouch.

The objective of the present invention is attained by redistributing the product in the pouch while the pouch is still in the web. More particularly, between the top sealer and the cutting wheel redistribution apparatus is provided. The redistribution apparatus has as its fundamental objective to twist the web in such a way that the bottom of each pouch is higher than its top so that the product tends to slide from the bottom toward the top.

A preferred form of the invention, comprises a web guide means comprising an upper belt conveyor and a lower belt conveyor, the two conveyors having adjacent runs. Pulleys at one end of the conveyors are on horizontal axes. The axes of the pulleys at the other end are adjustable to incline them, thereby imparting a twist to the belts. The web is passed over the upper run and between the adjacent runs in such fashion that the twist in the belts raises the bottom of the pouches above their sealed tops. The particulate material thus slides, by gravity, toward the sealed tops of the pouches during the excursion through the apparatus, thus redistributing itself.

The angle of twist is variable so as to provide a gentle slope or a severe slope to the pouches as well as slopes in between. Thus, the machine can be adjusted to product and operating conditions such as the speed of the machine and humidity of the plant environment.

The invention also contemplates apparatus for vibrating the pouches as they pass over the belts in order to shift even the most difficult to redistribute product.

BRIEF DESCRIPTION OF THE DRAWINGS

The several features and objectives of the present invention will become more readily apparent from the following detailed description taken in conjunction with the accompanying drawings in which.

DETAILED DESCRIPTION OF THE INVENTION

Figures 1, 5, 6:
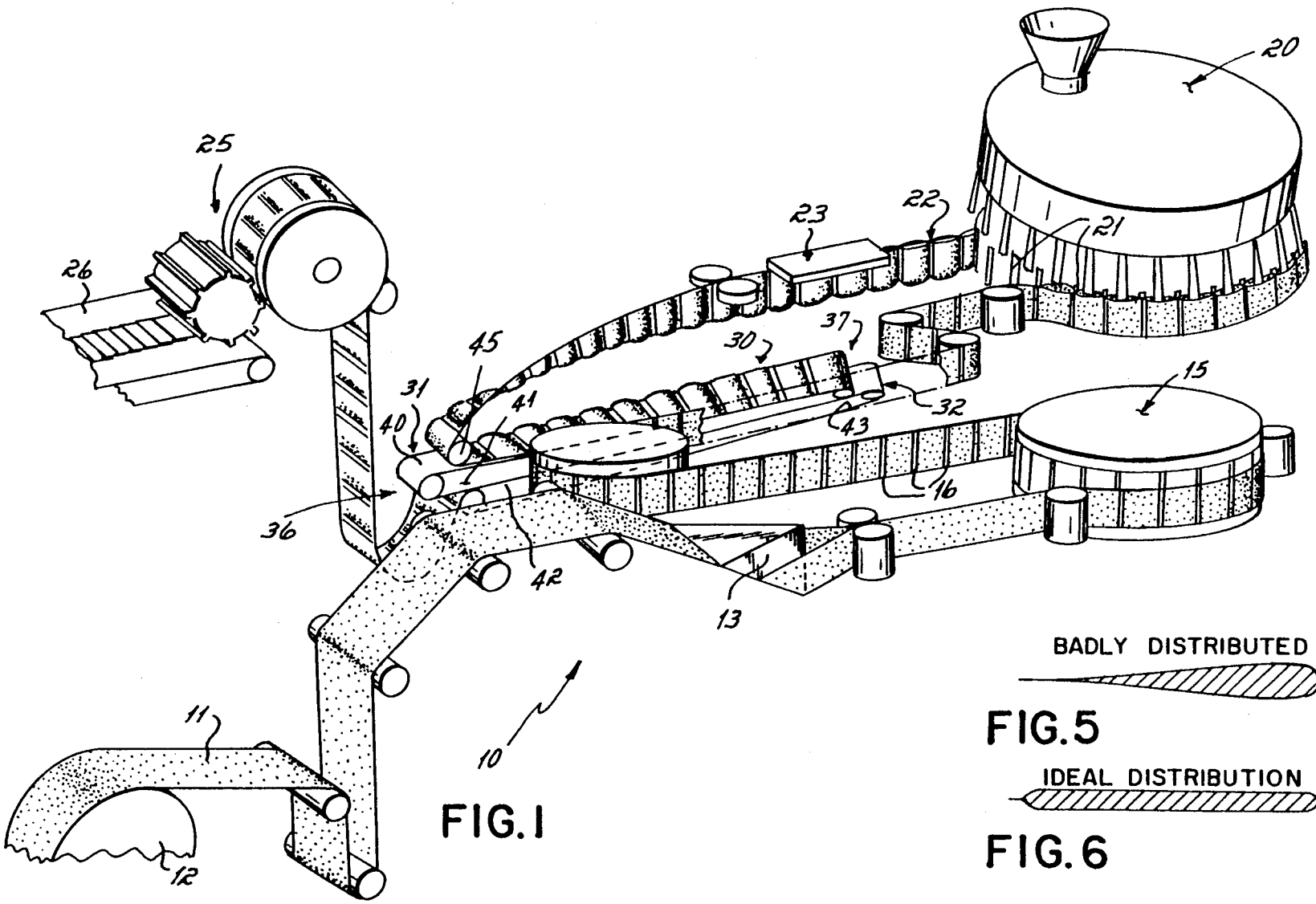
FIG. 1 is a diagrammatic perspective view of a pouch machine utilizing the present invention.
FIG. 5 is a diagrammatic, cross-sectional view of a pouch with badly distributed material.
FIG. 6 is a cross-sectional view of a pouch with an ideal distribution of product.

Apparatus 10 for making pouches is diagrammatically shown in FIG. 1. The pouch forming begins with a continuous web 11 from a supply roll 12. A web is folded upon itself over a plow 13. The web is of a material which will heat-seal upon itself such as a paper and polyethylene laminate (paper/poly). The folded web is passed around a heated sealing drum 15 where transverse seals 16 are formed to define individual pouches A thus formed web, open at the top, is fed to a filler 20. The individual pouches position themselves between vertical lands 21, and air or suction cups are employed to open the pouches. Filler tubes enter the pouches and a measured charge of particulate material is poured into the pouches.

The web of filled pouches, indicated at 22, is passed through a top sealer 23 to close the pouches. At this point, the particulate material is principally lodged in the bottom portion of each pouch. In the conventional machine, a web of pouches is swung from a vertical to a horizontal orientation and is fed to a cutting wheel 25 where individual pouches are cut from the web and deposited in shingled form on a conveyor 26.

The conveyor 26 carries the pouches to a check and release mechanism whereby the shingled pouches are separated into groups of a desired number and the groups are thereafter conveyed to product buckets where they are discharged into product buckets to form the stacks that are ultimately pushed into the cartons (see U.S. Pat. No. 4,043,442). Such stacks, without redistribution of the particulate material in the pouches, could be unstable and even fall over out of the product buckets. The product buckets, incidentally, are moved at high speed to the barrel loaders and the vibration of that conveying will tend to exacerbate the instability.

Figure 2:
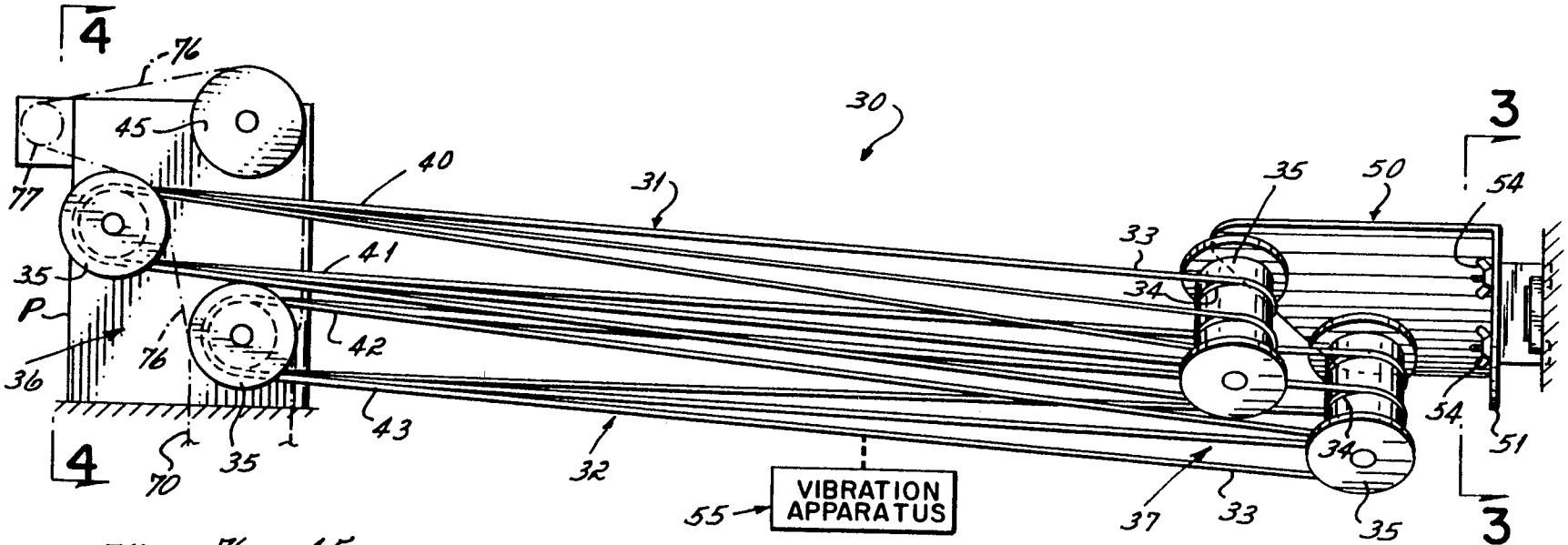
FIG. 2 is a side elevational view of the redistribution section.

To correct this problem, the redistribution apparatus indicated at 30 is introduced into the pouch forming machine between the top sealer 23 and the cutting wheel 25. As thus shown in FIGS. 2–4, the apparatus includes an upper conveyor 31 and a lower conveyor 32. Both conveyors are formed from a plurality of plastic tubes or belts 33 that are circular in cross section, and preferably elastomeric. The tubes are lodged in annular grooves 34 on horizontal axes formed in pulley spools 35. The apparatus has a fixed set 36 of spools at one end and an adjustable set 37 at its other end. The distance between pulley sets is about four to five feet. The upper conveyor has an upper run 40 and a lower run 41. The lower conveyor has an upper run 42 and a lower run 43, the runs 41 and 42 being adjacent to each other.

The conveyors are driven from fixed set of spools 36. A drive belt 70 drives live shaft 71 through drive pulley 71*a* thereon. The shaft drives lower spool 35. Upper pulley 35 and roller 45 are bearing mounted on dead shafts 72, 73 extending from plate P. Drive pulleys 74, 75 are bearing mounted on shafts 72, 73, respectively, and are attached to the upper spool 35 and roller 45, respectively. A timing belt 76 is operatively entrained around drive pulley 71*a*, pulleys 74, 75 and idler pulley 77 for driving the upper and lower conveyors 31, 32 and roller 45, as will be appreciated. Drive belt 70 is driven by a motor or other operative part of the pouch machine.

As shown in FIG. 1, the uncut web is passed around an idler pulley 45 and is disposed on top of the upper run 40 of the upper conveyor. The web is then returned between the adjacent lower run 41 of the upper conveyor and the upper run 42 of the lower conveyor.

Figure 3:
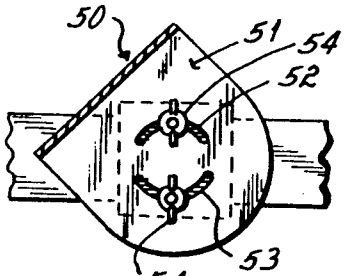
FIG. 3 is a cross-sectional view taken along line 3—3 of FIG. 2.
Figure 4:
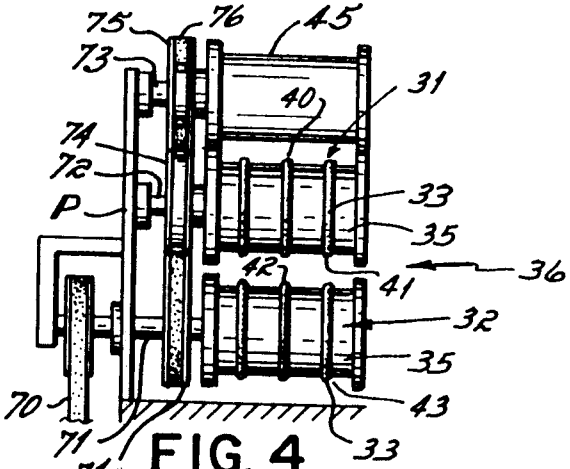
FIG. 4 is an end elevational view taken in the direction of the arrows 4—4 of FIG. 2.

The pulley spools 35 in the adjustable set 37 at the right-hand end of the apparatus are mounted on a bracket 50 having a plate 51. The plate 51 has arcuate slots 52 and 53 (FIG. 3). Wing nuts 54 permit the plate, carrying the spools 35, to be positioned at any angle up to approximately 45°, thus inclining the spool axes up to 45°. It will be appreciated that plate 51, and consequently the axes of rollers 35 thereon, can be positioned at any desirable angle. For illustrative purposes, a 45° tilt is shown, but plate 51 can be oriented anywhere from a 0° tilt to a 90° tilt. The arcuate slots 52 and 53 could be elongated, or made to index with different bolt holes in the frame to which it is mounted, to accommodate a tilt up to 90° or more to either side. In this way a twist is formed in the belts or tubes 33 and that twist is oriented with respect to the incoming web of pouches so as to raise the bottoms of the pouches to a maximum extent as they pass around the inclined pulley set 37. The pouches enter the apparatus in a horizontal attitude and exit at a horizontal attitude, but in essentially the entire remainder of the traverse to the inclined pulleys and back, the bottoms of the pouches are above the top sealed ends of the pouches. Gravity, coupled with the natural vibration of the apparatus, will cause the particulate material to shift from the upraised bottoms of the pouches toward the lower end until a fairly uniform distribution of the product in the pouches is attained. In so doing, the pouches, in cross section, will change from the original condition indicated in FIG. 5 to the ideal condition of FIG. 6.

The amount of flow from one end toward the other can be fine tuned by the angle at which the inclined pulleys are set. Further, more passes of the web around additional belt stages could be provided to increase the length of time that individual pouches remain in a bottom-up attitude. Still further, vibration apparatus indicated diagrammatically at 55 could be employed to shake the web as it passes through the apparatus, thereby to encourage the flow of the particulate material in the bottom toward the top end of the pouch.

The thus treated pouches, with the particulate material redistributed, as shown in FIG. 6, are easy to stack and easy to handle. The apparatus 30 can be tucked into available space in the pouch forming machine so as not to increase the overall footprint of the pouch forming machine on the manufacturer's floor.

It will be appreciated that while a preferred embodiment of the invention has been described, alternate structures could also be used. For example, another form of pouch web conveyance, or even some other web guide means for orienting the moving web to accomplish the objectives herein, could be utilized.

From the above disclosure of the general principles of the present invention and the preceding detailed description of a preferred embodiment, those skilled in the art will readily comprehend the various modifications to which the present invention is susceptible. Therefore, we desire to be limited only by the scope of the following claims and equivalents thereof:

We claim:

1. In a pouch machine where a continuous, vertically-oriented web which is folded upon itself and has vertical, longitudinally-spaced, transverse seals to form individual pouches which are filled with particulate material and sealed across the top of the pouches, apparatus for shifting said material from the lower end portion toward the upper end portion of each pouch comprising:

at least one endless belt passing about two longitudinally-spaced pulleys, said belt having an upper and a lower flight, the axis of at least one pulley being set at an angle to a horizontal plane and at an angle to said other pulley to twist said upper flight, means for passing said web over said upper flight of said belt with said belt gradually inclining the orientation of said web to raise said lower portion of each said pouch and thus to cause flow of said material toward the upper end portion of each pouch.

2. Apparatus as in claim 1 further comprising:

means for varying the angle of inclination of said at least one pulley.

3. Apparatus for redistributing particulate material in the bottoms of pouches that are interconnected in the form of a web comprising:

an upper belt having fixed and adjustable pulleys about which said belt passes, a lower belt having fixed and adjustable pulleys about which said lower belt passes, said belts have adjacent lower and upper runs, respectively, a bracket on which said adjustable pulleys are mounted, means for adjusting said bracket to vary the angle of inclination of said adjustable pulleys, said fixed pulleys being on horizontal axes, means for passing said web along the upper run of said upper belt and then between said adjacent runs with said adjustable pulleys being set to raise the bottoms of said pouches above their tops.

4. In a pouch form, fill, seal machine having means for forming vertical, transverse seals across a web that is folded upon itself to form a series of interconnected pouches that are open at the top, and having means for filling the pouches while they are vertically oriented, and having a top sealer for sealing the tops of pouches after they are filled, and a cutter wheel for severing pouches from said web, product redistribution apparatus between said top sealer and said cutter wheel comprising:

a conveyor for said web, said conveyor having means receiving vertically-oriented pouches having excess material in the bottom portions of the pouches and elevating the bottoms of the pouches above their tops to cause said material to flow toward the sealed tops of the pouches.

5. In a pouch machine wherein a series of pouches, each filled with particulate material, are interconnected into a continuously-moving web, apparatus for shifting said material from one end portion toward the end portion of each pouch comprising:

at least one endless belt passing about longitudinally-spaced pulleys, said belt having an upper and a lower flight, the axis of at least one pulley being set at an angle to a horizontal plane, means for passing said web over at least one flight of said belt with said belt inclining said web to raise said one portion of said pouch and thus to cause flow of said material toward the other end portion of each pouch, said web passing means passing said web first over said upper flight, then reversing its direction and passing said web along said lower flight.

6. In a pouch machine wherein a series of pouches, each filled with particulate material, are interconnected into a continuously-moving web, apparatus for shifting said material from one end portion toward the end portion of each pouch comprising:

at least one endless belt passing about longitudinally-spaced pulleys, said belt having an upper and a lower flight, the axis of at least one pulley being set at an angle to a horizontal plane, means for passing said web over at least one flight of said belt with said belt inclining said web to raise said one portion of said pouch and thus to cause flow of said material toward the other end portion of each pouch and a second endless belt passing around pulleys and having an upper flight passing adjacent said lower flight of said first named belt, said web passing over said upper flight of said first named belt and then, reversing direction by 180°, said web passing between said adjacent lower and upper flights.

7. In a pouch form, fill, seal machine having means for forming vertical, transverse seals across a web that is folded upon itself to form a series of interconnected pouches that are open at the top, and having means for filling the pouches while they are vertically oriented, a top sealer for sealing the tops of pouches after they are filled and a cutter wheel for severing pouches from said web, product redistribution apparatus between said top sealer and said cutter wheel comprising:

means for guiding said web, said guide means receiving vertically-oriented pouches having excess material in the bottom portions of the pouches and elevating the bottoms of the pouches above their tops to cause said material to flow toward the sealed tops of the pouches.

* * * * *